US008157979B2

(12) United States Patent
Lifchits

(10) Patent No.: US 8,157,979 B2
(45) Date of Patent: Apr. 17, 2012

(54) FILM HAVING COBALT SELENIDE NANOWIRES AND METHOD OF FORMING SAME

(75) Inventor: Alexandre D. Lifchits, Wyevale (CA)

(73) Assignee: Raytheon Canada Limited, Ottawa, Ontario (CA)

( * ) Notice: Subject to any disclaimer, the term of this patent is extended or adjusted under 35 U.S.C. 154(b) by 574 days.

(21) Appl. No.: 12/401,429

(22) Filed: Mar. 10, 2009

(65) Prior Publication Data

US 2010/0230286 A1 Sep. 16, 2010

(51) Int. Cl.
*C25D 5/02* (2006.01)

(52) U.S. Cl. ..... 205/118; 205/131

(58) Field of Classification Search ..... 205/118, 205/131, 159

See application file for complete search history.

(56) References Cited

U.S. PATENT DOCUMENTS 4,128,461 A 12/1978 Lerner et al.
2006/0270229 A1* 11/2006 Corderman et al. ..... 438/689

OTHER PUBLICATIONS

Huang et al., CoPt and FePt nanowires by electrodeposition, J. Appl. Phys. 91, 6869 (2002); doi:10.1063/1.1447524 (3 pages).*

Ji et al., Fabrication and magnetic properties of ordered 20 nm Co-Pb nanowire arrays, Solid State Communications, vol. 130, Issue 8, May 2004, pp. 541-545.*

A. Jagminas, et al., "Electrochemical synthesis and optical characterization of copper selenide nanowire arrays within the alumina pores", Journal of Crystal Growth, vol. 294, pp. 343-348, 2006.

G.H. Yue, et al., "Fabrication, structure, magnetic properties of highly ordered cobalt disulfide nanowire arrays", Applied Physics Letters, vol. 87, pp. 262505-1-262505-3, 2005.

S. Ono, et al., "Evaluation of pore diameter of anodic porous films formed on aluminum", Surface and Coatings Technology, vol. 169-170, pp. 139-142, 2003.

G.D. Sulka, et al., "Synthesis of Well-Ordered Nanopores by Anodizing Aluminum Foils in Sulfuric Acid", Journal of the Electrochemical Society, vol. 149, No. 7, pp. D97-D103, 2002.

G. Bailey, et al., "The Morphology of Anodic Films Formed on Aluminum in Oxalic Acid", Transactions of the Institute of Metal Finishing, vol. 52, pp. 187-199, 1974.

* cited by examiner

*Primary Examiner* — Luan Van
(74) *Attorney, Agent, or Firm* — Lando & Anastasi, LLP

(57) ABSTRACT

A method for making a film having an array of cobalt selenide nanowires including: providing an aluminum substrate; anodizing the aluminum substrate to form anodized aluminum including an aluminum oxide layer having a plurality of pores therein on a surface of the aluminum substrate; preparing an electrodeposition composition including a source of cobalt ions and a source of selenite ions; contacting the anodized aluminum with the electrodeposition composition; and applying AC current to the anodized aluminum for a sufficient duration to electrodeposit cobalt selenide into the pores to form a film having an array of oriented cobalt selenide nanowires. According to a different aspect, a film has an aluminum substrate; an oxide layer having a plurality of pores therein on a surface of the aluminum substrate; and an array of cobalt selenide nanowires disposed in the pores.

16 Claims, 1 Drawing Sheet

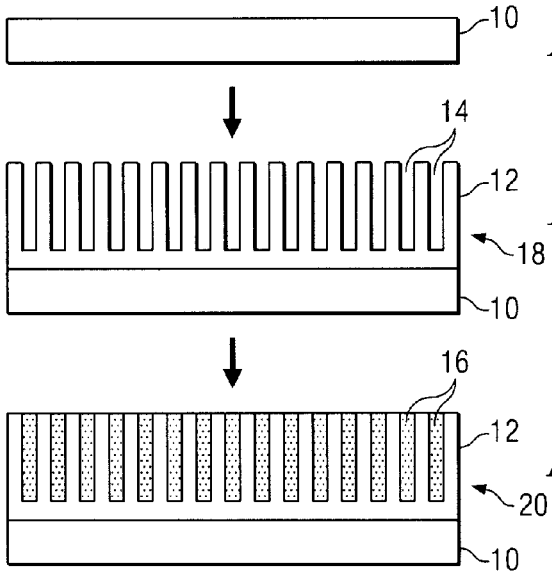
Fig. 1A
Fig. 1B
Fig. 1C
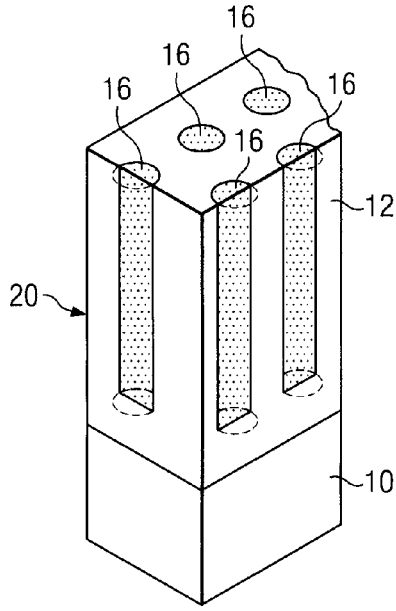
Fig. 2
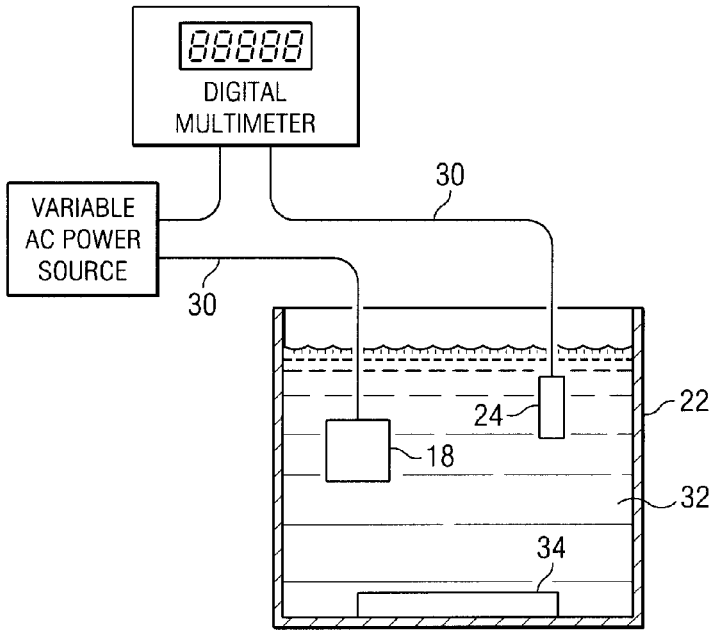
Fig. 3

FILM HAVING COBALT SELENIDE NANOWIRES AND METHOD OF FORMING SAME

FIELD OF THE INVENTION

This invention relates in general to films and methods for fabricating films and, more particularly, to films having nanowires and methods for fabricating them.

BACKGROUND

Nanowires are known in the art as wire structures having a diameter that is measured in hundreds of nanometers (nm) or less, typically measuring from 1 to 500 nm and having unique conductive, mechanical, and optical properties. There is interest in anodic films having nanowires therein for use in infrared detection and imaging equipment, magnetic recording, solar cells, batteries and as catalyst in organic synthesis.

While pre-existing approaches for template-assisted growth of nanowires have generally been adequate, they have not satisfactorily produced a film having an array of cobalt selenide nanowires.

BRIEF DESCRIPTION OF THE DRAWINGS

A better understanding of the present invention will be realized from the detailed description that follows, taken in conjunction with the accompanying drawings, in which:

FIGS. 1A, 1B and 1C, referred to collectively herein as FIG. 1, show a schematic diagram of a method used to produce a film having an array of cobalt selenide nanowires.

FIG. 2 is a fragmentary perspective view of the film produced by the process of FIG. 1.

FIG. 3 is a schematic diagram of an electrodeposition system used to carry out the process of FIG. 1.

DETAILED DESCRIPTION

FIG. 1 is a schematic diagram of a process that embodies aspects of the present invention, and that utilizes an aluminum substrate 10 with a porous oxide layer 12 to form cobalt selenide nanowires 16. FIGS. 1 and 2 show possible orientations of the film that have been arbitrarily selected to facilitate a clear and understandable explanation thereof. The depicted orientations are intended to be exemplary and not limiting.

An embodiment of the invention provides a method for making a film having an array of cobalt selenide nanowires including the following:

(a) providing an aluminum substrate 10;

(b) anodizing the aluminum substrate 10 to form anodized aluminum 18 having an aluminum oxide layer 12 and a plurality of pores 14 therein on a surface of the aluminum substrate;

(c) preparing an electrodeposition composition that includes a source of cobalt ions and a source of selenite ions;

(d) contacting the anodized aluminum 18 with the electrodeposition composition; and (e) applying alternating current (AC) to the anodized aluminum 18 for a sufficient duration to electrodeposit cobalt selenide into the pores 14 to form a film 20 having an array of oriented cobalt selenide nanowires 16 therein.

The nanowires 16 are substantially perpendicular to the plane of the aluminum substrate 10.

FIG. 2 is a fragmentary perspective view of film 20 showing the cobalt selenide nanowires 16 in a section of the oxide layer 12 and the aluminum substrate 10.

A suitable material for the aluminum substrate 10 is conventional pure aluminum or any aluminum alloy foil or plate that can be anodized such as, but not limited to, aluminum plate 6061-T6 available from Shimco North America Inc. According to certain embodiments of the invention, the aluminum substrate has a thickness from about 1.7 mm to about 11.5 mm. The aluminum foil is cleaned and degreased prior to the anodizing (b) using an alkaline cleaner like Aquatone LTC-2S from Atotech Canada Ltd.

The development of the oxide layer 12 on the aluminum substrate 10 is achieved through the use of standard anodic oxidation methods. The anodizing conditions influence the thickness of the oxide layer, pore diameter, the pore depth, and the interpore distance. Since the length and diameter of each cobalt selenide nanowire is determined by the corresponding pore diameter and length, changing the anodizing conditions makes it possible to control the diameter and length of the cobalt selenide nanowires, examples of such anodizing conditions being described in Bailey et al., *The Morphology of Anodic Films Formed on Aluminum in Oxalic Acid*, Transactions of the Institute of Metal Finishings, 52, 187 (1974); and Ono et al., *Evaluation of pore diameter of anodic porous films formed on aluminum*, Surface and Coatings Technology, 169-170, 139 (2003), the entire disclosures of which are hereby incorporated herein by reference.

According to certain embodiments of the invention, the aluminum substrate is anodized using standard procedures such as, but not limited to, U.S. Military Specification Anodizing, MIL-A-8625 type II without dye and seal or type III without dye and seal using the Sanford process as described in U.S. Pat. No. 2,743,221, the entire disclosure of which is hereby incorporated herein by reference.

Certain embodiments of the invention provide that the aluminum substrate is etched for 30-60 seconds in mixture of 10-30% by weight sulfuric and 5-10% by weight hydrofluoric acids such as CH-60 from HENKEL Corporation, deoxidized in nitric acid, and anodized in about 180 g/L sulfuric acid at 20° C. and 1.5 A/sq.dm current density.

The depth of the pores is closely associated with anodic film thickness, which is controlled by anodizing time and can be from above zero to a maximum achievable thickness. The anodizing process determines the maximum achievable thickness. Certain embodiments of the invention provide that the Sanford process of anodizing yields a maximum achievable thickness of 300 microns.

According to certain embodiments of the invention, the anodizing is adjusted such that the pores 14 in the oxidized layer 12 each have a diameter of less than 50 nm and a depth of less than 300 microns. According to other embodiments, the diameter of each of the pores in the oxide layer 12 is less than 50 nm, less than 40 nm, less than 30 nm, or less than 20 nm. Other embodiments of the invention provide that each of the pores 14 has a depth of less than 15 microns or less than 10 microns.

The electrodeposition solution is composed of about 50 mM/L to about 150 mM/L of each of the following: a source of cobalt ions, a source of selenite ions, and a neutral salt. During the electrodeposition process, the selenite ions are reduced to selenide ions. The cobalt ions source is a conventional reagent having cobalt ions such as, but not limited to cobalt acetate tetrahydrate, which is commercially available as Cobalt Acetate Tetrahydrate, Baker Analyzed™ Reagent. 99.0% min available from Mallinckrodt Baker, Inc.; cobalt sulfate, or combinations thereof. The source of selenite ions is a conventional reagent having selenite ions such as, but not limited to, selenous acid, which is commercially available as Selenous Acid, 97% available from Alfa Aesar, sodium selenite, or combinations thereof. The neutral salt increases conductivity of the electrodeposition solution. Examples of neutral salt are magnesium sulfate heptahydrate such as Magnesium Sulfate Heptahydrate, Guaranteed Reagent, ACS Grade available from EMD Chemicals Inc.; or sodium sulfate.

According to certain embodiments of the invention, the quantities of the source of cobalt ions and source of selenite ions are adjusted to achieve a desired ratio of selenium to cobalt. The electrodeposition solution contains a source of cobalt ions from about 50 mM/L to about 150 mM/L, such as but not limited to, cobalt acetate tetrahydrate is present in either 50 mM/L, 100 mM/L, or 150 mM/L. Also according to certain other embodiments of the invention, the electrodeposition solution contains a source of selenite ions in a concentration from about 50 mM/L to about 150 mM/L such as, but not limited to, selenous acid concentration of either 50 mM/L, 100 mM/L, or 150 mM/L. In certain other embodiments of the invention, the neutral salt is added in a concentration of 50 mM/L, 100 mM/L, or 150 mM/L of the electrodeposition solution.

According to certain embodiments of the invention, the pH of the electrodeposition solution is adjusted to a range of from about 3.4 to about 5.0 by the addition of sulfuric acid or sodium hydroxide solution. Lowering the pH of the electrodeposition solution decreases the cobalt content deposited during the electrodeposition process. Eventually, if the pH is below about 3.4, only elemental selenium is deposited in the pores, thus, providing an array of selenium nanowires.

According to certain embodiments of the invention, adjusting the pH of the electrodeposition solution determines the atomic ratio of cobalt and selenium in the cobalt selenide nanowires. The electrodeposition solution having a pH in a range of from about 3.4 to about 5.0 results in electrodeposition of cobalt selenide nanowires having a ratio of selenium to cobalt of about 0.5 to about 3. Another embodiment of the invention provides an electrodeposition solution having a pH in a range of from about 4.5 to about 4.8 which results in electrodeposition of cobalt selenide nanowires having a ratio of selenium to cobalt of from about 0.85 to about 2.05.

FIG. 3 depicts an electrodeposition system used to deposit cobalt selenide into the pores 14 of the oxide layer 12. The electrodeposition system has a plurality of electrodes 18 and 24 in a bath container 22 and a power source 26 operably coupled by wires 30 to the plurality of electrodes. The electrodes can be conventional electrodes such as, but not limited to, anodized aluminum, graphite, or platinum electrodes. A certain embodiment of the invention provides a system having an electrode that is anodized aluminum 18 and a counter electrode 24 that is a conventional graphite electrode such as made from graphite sheet available from Alfa Aesar. An end of the anodized aluminum electrode is microblasted using a conventional microblaster, such as a Model MB1002 available from Comco Inc., to remove the insulating oxide layer and connected via conventional wiring to the AC power source. The oxide layer is removed to reveal the aluminum substrate. The power source is a conventional power source such as a variable autotransformer suitable for supplying alternating current with a 0 to 25 volt output, which is commercially available as type 136B from The Superior Electric Co. The power source is controlled by a digital multimeter such as model 177 available from Fluke Corporation.

During the electrodeposition process, the bath container is filled with room temperature electrodeposition solution 32 and at least two electrodes are placed therein. According to certain embodiments of the invention, the anodized aluminum 18 and graphite counterelectrode 24 are both submersed in the electrodeposition solution. The bath container includes a mechanism for mechanical agitation of the electrodeposition solution such as, but not limited to, a magnetic stirrer 34.

The electrodeposition process uses AC current, not DC current. DC current disadvantageously changes the pH in the reaction zone and limits diffusion of the reagents into the pores. During electrodeposition, the power source supplying AC current is operated at constant current densities in a range of from about 0.1 A/sq. dm to about 1.0 A/sq. dm. Another embodiment of the invention provides that the constant current density is applied in a range of from about 0.3 A/sq. dm to about 0.5 A/sq. dm during the electrodeposition. According to a certain embodiment, the duration of the electrodeposition process depends on the size of the pores in the anodized aluminum i.e. long nanowires are synthesized in deep pores and, thus, the electrodeposition process takes a longer time. Certain embodiments of the invention provide that the constant current is applied for a duration of about 30 minutes to about 60 minutes.

Another embodiment of the invention provides that constant voltage of from about 15 to about 30 volts is applied to the electrodes, while current gradually decreases by itself during the electrodeposition process over time. An embodiment of the invention provides for the application of a constant voltage in a range of from above 20 to about 30 volts for about 30 minutes. According to a certain embodiment of the invention, the constant voltage is applied at about 25 volts for about 30 minutes.

After electrodeposition, film 20 is rinsed with distilled or deionized water and dried by contacting film 20 to blowing air at room temperature.

The resulting film includes an aluminum substrate, an oxide layer having a plurality of pores therein on a surface of the aluminum substrate, and an array of cobalt selenide nanowires disposed in the pores. The nanowires are oriented in the film so as to be substantially perpendicular to the plane of the aluminum substrate.

The length and diameter of each nanowire is determined by the depth and diameter of the pore in which it resides. According to certain embodiments of the invention, the nanowires 16 residing in the pores 14 each have a diameter of less than about 50 nm and a length of less than about 300 microns. According to other embodiments of the invention, the diameter of each nanowire is less than about 40 nm, less than about 30 nm, or less than about 20 nm. Other embodiments of the invention provide that the nanowires have a length of less than about 20 microns, less than about 15 microns, or less than about 10 microns. The invention includes a method for varying the dimensions of the cobalt selenide nanowires in the film by changing the diameter and depth of the pores 14 in the oxide layer 12.

Also according to certain embodiments of the invention, the cobalt selenide nanowires are composed of an atomic ratio of selenium to cobalt in a range of from about 0.5 to about 3. Another embodiment of the present invention provides that the cobalt selenide nanowires are composed of an atomic ratio of selenium to cobalt in a range of from about 0.85 to about 2.05.

In yet another embodiment of the invention, the cobalt selenide nanowires are disengaged from the film by removal of the oxide layer 12. A strong base such as, but not limited to 1.0 M NaOH dissolves the oxide layer leaving free-standing cobalt selenide nanowires, which can be used in a variety of applications.

The following examples are provided for illustration and not limitation.

EXAMPLE 1

Samples of aluminum 6061-T6 alloy plate having a thickness of 1.7 mm from Shimco were anodized according to the MIL-A-8625 procedures. The plate aluminum samples were cleaned in alkaline cleaner, etched for 30-60 sec in mixture of sulfuric and hydrofluoric acids such as CH-60 from HENKEL Corporation, deoxidized in nitric acid and anodized in about 180 g/L sulfuric acid at 20° C. and 1.5 A/sq.dm current density. The oxidized layer was about 11 microns thick and contained pores having a diameter of about 40 nm and a depth of about 10 microns. The porous oxidized layer was preserved by rinsing in cold deionized water and dried by blowing air.

The electrodeposition solution was prepared from 50 mM/L each of cobalt acetate tetrahydrate, selenous acid, and magnesium sulfate heptahydrate. The pH of the electrodeposition solution was 4.5 after preparation.

The electrodeposition process was performed at room temperature in a 1 L glass beaker with a magnetic stirrer. AC current was supplied by a variable autotransformer having a 0-25V output commercially available as POWERSTAT® Model 136B from Superior Electric Co. and was controlled by a digital Fluke multimeter model 177. Conventional wires made of copper were connected to the variable autotransformer and to the anodized aluminum plate, which functioned as an electrode. The copper wire was contacted with an end of the aluminum oxide plate having part of the insulating anodized layer removed by microblasting. The microblasting was achieved using a small nozzle fitted on Model MB1002 commercially available from Comco Inc. The end of the aluminum oxide plate was microblasted until the oxide layer was removed to reveal the shiny aluminum substrate layer. The anodized aluminum plate was then placed in the beaker containing the electrodeposition solution. A second, counter electrode made from graphite from Alfa Aesar was also placed in the beaker.

A constant voltage of 25V was applied to the electrodes for about 30 minutes. Cobalt selenide nanowires were deposited in the pores of the porous anodic layer of the anodized aluminum substrate.

The cobalt selenide nanowires had an atomic ratio of selenium to cobalt of 2.05 as determined by using conventional x-ray fluorescence ("XRF") techniques. Standards containing cobalt or selenium were used to calibrate the x-ray spectrometer.

EXAMPLE 2

The aluminum samples were anodized as described in Example 1.

The electrodeposition composition included 150 mM/L of cobalt acetate tetrahydrate, 50 mM/L of selenous acid, and 50 mM/L of magnesium sulfate heptahydrate. The initial pH of the electrodeposition composition was 5.1 and was adjusted to 4.8 by the dropwise addition of sulfuric acid.

The electrodeposition process was performed at room temperature in a 1 L glass beaker with a magnetic stirrer. AC current was supplied by a variable autotransformer with 0-25V output and was controlled with the help of a digital Fluke multimeter. Conventional copper wires connected the variable transformer to the anodized aluminum electrode that was an anodized 6061-T6 aluminum plate. An end of the anodized aluminum plate was microblasted as described above in Example 1 to remove the insulating oxide layer and was connected to the copper wire. The anodized aluminum electrode was placed in the beaker containing the electrodeposition solution. A second, counter electrode made from graphite was also placed in the beaker. Deposition occurred at a constant current density 0.35 A/sq. dm and took about 30 minutes.

The cobalt selenide nanowires had an atomic ratio of selenium to cobalt of 0.85 as determined by conventional XRF analysis. Standards containing cobalt or selenium were used to calibrate the x-ray spectrometer.

Although selected embodiments have been illustrated and described in detail, it should be understood that a variety of substitutions and alterations are possible without departing from the spirit and scope of the present invention, as defined by the claims that follow.

What is claimed is:

1. A method for making a film having an array of cobalt selenide nanowires comprising:

(a) providing an aluminum substrate;

(b) anodizing said aluminum substrate to form anodized aluminum including an aluminum oxide layer having a plurality of pores therein on a surface of said aluminum substrate;

(c) preparing an electrodeposition composition including a source of cobalt ions and a source of selenite ions;

(d) contacting said anodized aluminum with said electrodeposition composition; and (e) applying AC current to said anodized aluminum for a sufficient duration to electrodeposit cobalt selenide into said pores to form a film having an array of oriented cobalt selenide nanowires.

2. A method according to claim 1, wherein said anodizing is carried out in such a way that said pores have a diameter of less than about 50 nm.

3. A method according to claim 1, wherein said anodizing is carried out in such a way that said pores have a depth of less than about 300 microns.

4. A method according to claim 1, wherein said preparing of said electrodeposition composition is carried out in such a way that the pH of said electrodeposition composition achieves said nanowires having a desired ratio of selenium to cobalt.

5. A method according to claim 1, wherein said preparing of said electrodeposition composition includes adjusting the quantities of a source of cobalt ions and a source of selenite ions to achieve said nanowires having a desired ratio of selenium to cobalt.

6. A method according to claim 1, wherein said method is carried out in such a way that said cobalt selenide nanowires include an atomic ratio of selenium to cobalt in the range of about 0.5 to about 3.

7. A method according to claim 6, wherein said method is carried out in such a way that said cobalt selenide nanowires include an atomic ratio of selenium to cobalt in the range of about 0.85 to about 2.05.

8. A method according to claim 1, wherein said applying AC current is performed at a constant current density in a range of about 0.1 A/sq.dm to about 1.0 A/sq.dm.

9. A method according to claim 8, wherein said applying AC current is performed at a constant current density in a range of about 0.3 Amps/sq.dm to about 0.5 A/sq.dm.

10. A method according to claim 8, wherein said constant current is applied for a duration of about 30 minutes to about 60 minutes.

11. A method according to claim 1, wherein said applying AC current is performed at a constant voltage in a range of from about 5 to about 30 volts.

12. A method according to claim 11, wherein said applying AC current is performed at a constant voltage in a range of from above about 20 to about 30 volts.

13. A method according to claim 11, wherein said constant voltage is applied for a duration of about 30 minutes to about 60 minutes.

14. A method according to claim 1, including removing said oxide layer such that said cobalt selenide nanowires are disengaged from said anodized aluminum.

15. A method according to claim 14, wherein said method is carried out in such a way that said cobalt selenide nanowires include more than one nanowire having a length of less than about 300 microns and a diameter of less than about 50 nm.

16. A method according to claim 1, wherein said method is carried out in such a way that said nanowires are substantially perpendicular to the plane of the aluminum substrate.

* * * * *